US008002159B2

(12) United States Patent
Cragg

(10) Patent No.: US 8,002,159 B2
(45) Date of Patent: Aug. 23, 2011

(54) INTERLOCK ATTACHING STRAP

(75) Inventor: James Victor Cragg, Carson, CA (US)

(73) Assignee: S.O. Tech Special Operations Technologies, Inc., Carson, CA (US)

( * ) Notice: Subject to any disclaimer, the term of this patent is extended or adjusted under 35 U.S.C. 154(b) by 429 days.

(21) Appl. No.: 12/146,372

(22) Filed: Jun. 25, 2008

(65) Prior Publication Data

US 2008/0257922 A1 Oct. 23, 2008

Related U.S. Application Data

(63) Continuation-in-part of application No. 11/000,113, filed on Nov. 29, 2004, now abandoned.

(51) Int. Cl.
*A45F 5/00* (2006.01)

(52) U.S. Cl. ..... 224/579; 224/675; 24/3.7

(58) Field of Classification Search ..... 224/579, 224/578, 580, 222, 583, 661, 250, 269, 671–675, 224/255, 901; 2/338, 101, 102; 24/3.7, 3.5, 24/3.9

See application file for complete search history.

(56) References Cited

U.S. PATENT DOCUMENTS 842,498 A 1/1907 Schmidt
2,343,142 A * 2/1944 Freedman ..... 24/713.1
4,668,202 A * 5/1987 Scheurer et al. ..... 441/112
4,712,646 A * 12/1987 Page ..... 182/9
5,259,093 A * 11/1993 D'Annunzio ..... 24/3.9
5,724,707 A 3/1998 Kirk et al.
6,108,816 A 8/2000 Bradley
6,279,804 B1 8/2001 Gregg
6,371,346 B1 4/2002 Sharma
6,431,420 B1 8/2002 Cragg
6,582,267 B1 * 6/2003 Steger ..... 441/112
7,047,570 B2 5/2006 Johnson
7,080,430 B2 7/2006 Wemmer
7,200,871 B1 4/2007 Carlson
7,240,404 B2 * 7/2007 Flossner ..... 24/3.7
2006/0206986 A1 * 9/2006 Straiton ..... 2/238

* cited by examiner

*Primary Examiner* — Justin M Larson
*Assistant Examiner* — Corey N Skurdal
(74) *Attorney, Agent, or Firm* — Cislo & Thomas, LLP

(57) ABSTRACT

The present invention discloses an interlock attaching strap system, comprising a carrier having a plurality of first webbing strips transversely, evenly and spacedly affixed thereon, a holder having a plurality of second webbing strips transversely, evenly and spacedly affixed thereon, wherein by overlapping the carrier and holder, the first webbing strips and the second webbing strips are capable forming an elongate interlocking channel; at least an elongated interfering strap, which is longitudinally extended on the holder, having an affixing end extended from a peripheral edge of the holder and a free tab end, arranged to slidably pass through the interlocking channel and is hooked onto the last webbing strip so as to securely reinforce the holder on the carrier via the interfering strap.

18 Claims, 6 Drawing Sheets

INTERLOCK ATTACHING STRAP

CROSS-REFERENCE TO RELATED APPLICATION

This patent application is a continuation-in-part of and claims the benefit of U.S. patent application Ser. No. 11/000,113, entitled "Interlock Attaching Strap," filed Nov. 29, 2004 now abandoned, which application is incorporated in its entirety here by this reference.

TECHINICAL FIELD

The present invention relates to a strap attaching system for attaching objects, and more particularly, relates a tab interlock attaching strap system for detachably attaching one object, such as an article holder, to a carrier, such as a supporting pad, a utility vest, a garment, a pouch, a bag, and so on, in a secure, durable, reliable, effective, and convenient manner.

BACKGROUND

Commonly, many professionals or technicians employ article holders to facilitate their job duties, for example, militant personnel or police officials need article holders to carry varying weapons, ammos, holsters, communicating means, pouches, water bottles, etc., correspondents and photographers need article holders to carry camera cases, optical peripherals, and related equipments, and maintenance workers need article holders to carry utility apparatus and so on.

An easy way to attach such article holders to the supports is to permanently sewing the article holders onto the support, for example sewing a pouch onto a vest. However, the article holders sewn on the support could not be repositioned or removed from the supports. Apparently, this kind of permanently attaching method is not welcomed by those personnel, such commando soldiers who eagerly need a versatile load-bearing vest for carrying different apparatuses. Instead, a releasable article holder enables the soldier to design his own vest or supporting pad, to change items from time to time under different circumstances.

As a result, the article holders are frequently fastened to a support such as a user's modular load-bearing vest, supporting pad, or a utility strap provided on a back pack, in a releasable way. There are a variety of methods existed for detachably attaching article holders to the supports. The most common method is to use fastening means directly attaching the article holders to the supports. Such fastening means include hook and loop fasteners, Velcro fasteners, snap fasteners, buckle fasteners, and so on.

However, all above mentioned fastening means had been proved inefficient, unrealistic, expensive or unreliable in practical applications. And more importantly, these fastening means are bulky, uncomfortable and user unfriendly. First of all, these fasteners are made of metal or plastic materials with certain extents of rigidity. So that such metal and plastic fastener would more or less rely on mechanisms to be functioned or purposed, and unquestionably, cause discomfort and uneasiness to the user when positioned close the body.

For instance, the buckle fasteners are not easy to be fastened when the article holder, such as a pouch is heavily stuffed or plumped. And more importantly, such fasteners need releasing mechanism to facilitate the disengagement. In a long run, such releasing mechanisms will more or less be degraded thus resulting malfunctions, or unwanted disengagements. Even though the Velcro fasteners are not relied on the metal or plastic mechanism, but its noise and unreliability are unacceptable to most users.

So, a new type of light weight, low bulky, user-friendly, reliable strap fastening means had been introduced into market to replace traditional fasteners for detachably attaching the article holders to the vests or supporting pads. This kind of user friendly strap attaching fasteners occupies less space and is relative overlapped flatly with respect to the user.

Some strap fasteners are made of fabric sewn to the back of the support to form fabric loops provided on the back of the supports through which a belt or a strap is engaged with such fabric loops for suspendedly attaching an article holder to the supporting pad.

Other strap fastening means comprise at least a mounting panel provided on a first object, such as load-bearing vest or a supporting pad, with a plurality of strip webbings evenly spaced and sewn across the surface of the mounting panel. So that there is a plurality of spacing between strip webbings with a predetermined width formed on the mounting panel. On the other hand, there is a plurality of strip fabrics sewn on the second object, such as an object holder. The spacing width between strips webbings on the mounting panel are sufficient to allow a plurality of the strip fabrics on the second object to fit there between.

In the meanwhile, the strip webbings are further attached on the mounting panel by perpendicular stitching such as to create longitudinal channels therein which are utilized for the insertion of a strap therein, the strap has an affixing end being attached at one end to the second object, and a free end which is adapted to be passing through the webbings and fabrics respectively defined on the mounting panel and the second object in an alternating manner so as to detachably attach the second object to the mounting panel of the first object.

In short, the above mentioned strap attaching system utilize a flexible strap for detachably coupling two objects in an attaching manner by interweaving such flexible strap between two objects. So that two separated objects could be attached together in a secure manner. In other words, the second object and first object will not disengage until user intentionally and physically separated the first and second object by pulling back the engaging strap.

However, one disadvantage of using flexible straps is that it is usually difficult to deal with the free end of the strap. For example, the free end may have to be tucked behind a belt or a pack strap that is tightly pressed against a body or backpack. However, when the second object is not positioned adjacent to a belt or a pack strap, the free end of the flexible strap has to be tucked back to the fabric loops, or otherwise, there would be a receiving cavity defined on the second object for tucking back the free end of the strap. However, since the two ends of such flexible strap are both positioned on the second object, the attaching efficacy of such strap fastening means could not be effectively guaranteed. For example, a bulged second object will loosen the fastening effect after a prolonged service.

In some embodiments, a fastening element, such snaps, buckles, hook-and-loop fasteners is formed on the free end of the flexible strap to detachably attach such flexible strap to the first object. This enables a user to push the free ends interweave between webbings and fabrics defined on the mounting panel of the first object and the second object.

However, there is a hardware associated with this attaching strap, such as a snap button, or a clip, being provided on the free end of the flexible strap. By reutilizing the clips and snaps, the life span of the strap attaching system are once again subject to the vulnerability of such fasteners, such as rust or damage, thereby becoming unserviceable when applied in the most extreme operating conditions.

What is more, to ensure the second object is permanently affixed to the first object so it cannot be lost or otherwise separated from the first object, the free end of the strap, having one end affixed to the second object, is preferably, affixed to the first object for providing a firmed attaching effect. Otherwise, the second object just looks like an object hanging on the first object rather than attaching on the first object.

So it is desirable to develop an interlock strap attaching system that not only has simple interweaving function and modular applications, but also provides an efficient and securable fastening arrangement to the free end of such strap.

SUMMARY OF THE PRESENT INVENTION

A primary object of the present invention is to provide a tab interlock attaching strap system for overcoming the aforementioned drawbacks of attaching strap system, while maintaining the good features of those interlock attaching strap system, such as ease of removal, convenient operation, flat engagement, and so on.

Another object of the present invention is to provide a tab interlock attaching strap system, wherein no hardware elements are involved so as to ensure such strap system being inexpensive, reliable, and easily repairable.

Another object of the present invention is to provide a tab interlock attaching strap system, wherein the strap has an affixed end provided on a second object, such as a holder, while the other free end is arranged to be tucked back in the first object, such as a carrier, to create an interlock attaching strap system that allows the loader and the carrier detachably to be attached in a stable manner.

Another object of the present invention is to provide a hook structure to hook onto a webbing strip to prevent unwanted removal of the interfering strap.

Another object of the present invention is to provide a tab interlock attaching strap system, wherein the free end of the strap is embodied as a stiffened member by using a tab, so that the maneuverability of such strap could be easier while interweaving between the holder and the carrier.

Another object of the present invention is to provide a tab interlock attaching strap system, wherein the plastic reinforcement length of the strap is avoided, instead, the tab is utilized for facilitating the adjustable and flexible insertion.

1. Accordingly, to achieve the above mentioned objects, the present invention provides a tab interlock attaching strap system, comprising a carrier, having a carrying side, adapted for being carried by a wearer; a holder having a loading side and an opposed holding side corresponding to said carrying side of said carrier; and an interlocking arrangement, which comprises a plurality of first webbing strips transversely, evenly and spacedly affixed on said carrying side of said carrier and defining a plurality of transverse carrier slots between said first webbing strips and said carrying side of said carrier; a plurality of second webbing strips transversely, evenly and spacedly affixed on said holding side of said holder and defining a plurality of transverse holder slots between said holding side of said holder to align with said transverse carrier slots respectively to form an elongated interlocking channel when said holding side of said holder is overlapped on said carrying side of said carrier to alternate said first webbing strips with said second webbing strips; at least an elongated interfering strap, which is longitudinally extended on said holder, having an affixing end extended from a peripheral edge of said holder and a free tab end, which is arranged to slidably pass through said interlocking channel to securely interlock said holder with said carrier so as to securely reinforce said holder on said carrier via said interfering strap, wherein said free tab end of said interfering strap is overlappedly folded back onto said interfering strap to form a double layer at the free tab end and create a stiffness and wherein said free tab end is stitched to form a dual layer hook structure arranged to slide along said interlocking channel towards said opposed peripheral edge of said holder and hook a last webbing strip so as to prevent said interfering strap from being pulled backward.

These and other objectives, features, and advantages of the present invention will become apparent from the following detailed description, the accompanying drawings, and the appended claims.

DETAILED DESCRIPTION OF THE INVENTION

Figure 1:
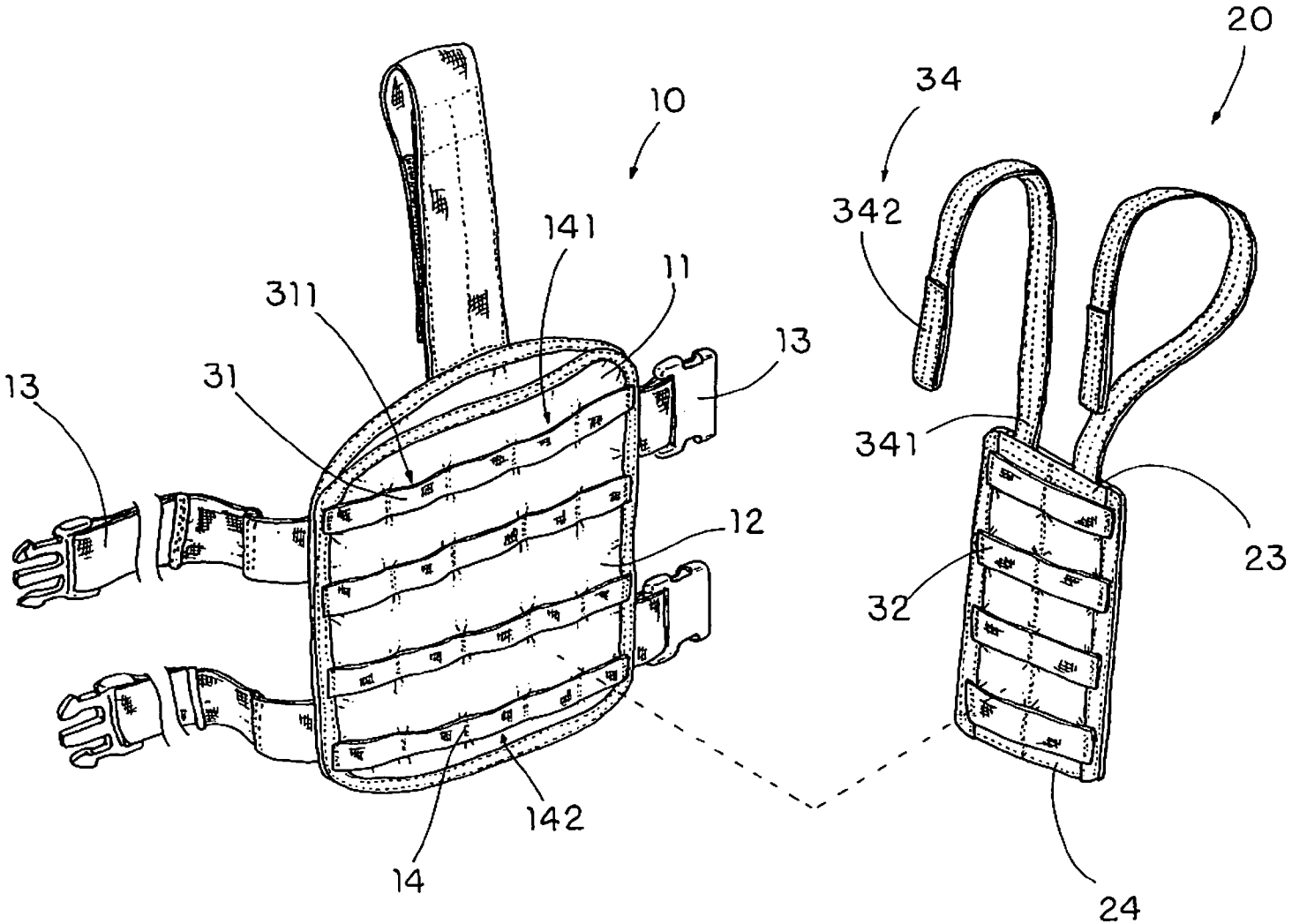
FIG. 1 is an exploded perspective view of an embodiment of the present invention.

Referring to FIG. 1 to FIG. 6, the interlock strap attaching system 1 according to the preferred embodiment of the present invention is illustrated. In order to overcome the aforementioned drawbacks of conventional attaching strap system, the present invention provides a tab interlock attaching strap system 1, which comprises a carrier 10, having a carrying side 11, adapted for being carried by a wearer, and a holder 20 having a loading side 21 and an opposed holding side 22 corresponding to the carrying side 11 of the carrier 10.

Furthermore, the tab interlock attaching strap system comprises an interlocking arrangement 30, which comprises a plurality of first webbing strips 31 transversely, evenly and spacedly affixed on the carrying side 11 of the carrier 10 and defining a plurality of transverse carrier slots 311 between the first webbing strips 31 and the carrying side 11 of the carrier 10. Furthermore, the interlocking arrangement 30 comprises a plurality of second webbing strips 32 transversely, evenly and spacedly affixed on the holding side 22 of the holder 20 and defining a plurality of transverse holder slots 321 between the second webbing strips 32 and the holding side 22 of the holder 20 to align with the transverse carrier slots 311 respectively to form an elongated interlocking channel 33 when the holding side 22 of the holder 20 is overlapped on the carrying side 11 of the carrier 10 to alternate the first webbing strips 31 with the second webbing strips 32.

In addition, the interlocking arrangement 30 comprises at least an elongated interfering strap 34, which is longitudinally extended from the holder 20, having an affixing end 341 extended from a peripheral edge 23 of the holder 20 and a free tab end 342, which is arranged to slidably pass through the interlocking channel 33 to securely interlock the holder 20 with the carrier 10 and is overlappedly tucked back to the carrying side 11 of the carrier 10 within the transverse carrier slot 311 at an opposed peripheral edge 24 of the holder 20, to enclose the free tab end 342 of the interfering strap 34 between the carrier 10 and the holder 20 so as to securely reinforce the holder 20 on the carrier 10 via the interfering strap 34.

In other words, the carrying side 11 of the carrier 10 functions as a mounting surface for detachably attaching the holder 20 in a secure and detachable manner. The first webbing strips 31 and the second webbing strips 32 are respectively defined on the carrier 10 and the holder 20 to form transverse carrier slots 311 and transverse loader slots 321. Meanwhile, the carrier 10 and the holder 20 could be overlappedly disposed so that the carrier slots 311 and the loader slots 321 are aligned in an alternate way forming an extended interlocking channel 33. The interlocking channel 33 is an extending passageway defined longitudinally from an upper portion to a lower portion of the mounting surface of the carrier 10. Therefore, by sequentially passing the free tab end 342 of the interfering strap 34 through the interlocking channel 33, the holder is capable of being attached onto the carrier 10.

In short, the interlock attaching strap system 1 is adapted for attaching a holder, such as an article holder to a carrier, such as a load-bearing vest, a supporting pad, a utility garment, each of which has a mounting surface defined thereon. As shown in FIG. 1, each of first webbing strips 31 may be stitched to the mounting surface, for extending across the carrying side 11 of the carrier 10, the carrier slots 311 are defined between the carrying side 11 and the first webbing strips 31. The plurality of the first webbing strips 31 may be evenly and spacedly defined across the mounting surface so as to create a plurality of the elongated groove 12 on the carrying side 11 of the carrier 10 for allowing the second webbing strips 32 disposed thereon in an alternating manner.

Accordingly, the second webbing strip 32 is stitched on the holding side 22 of the holder 20. It is noted that the width of each elongated groove 12 defined on the carrier 10, i.e. the width between adjacent first webbing strips 31, is of sufficient measurement, so that the second webbing strips 32 defined on the holder 20 is capable of being placed into such elongated grooves 12 respectively.

In other words, the distance between each two adjacent first webbing strips 31 is at least larger than a width of the corresponding second webbing strip 32 to allow the first webbing strips 31 positioning with the second webbing strips 32 in an alternating manner so as to communicate the carrier slots 311 with the holder slots 321 to form the elongated interlocking channel 33.

According to the preferred embodiment of the present invention, there is a plurality of stitching 14 perpendicularly and spacedly stitched on each of the first webbing strip 31 so as to divide the carrier slot 311 into a plurality of engaging sub-slots 141 laterally adjoining with each other along the first webbing strip 31. It is noted that such stitching 14 are alignedly stitched on each of the first webbing strip 31 being held in place on the carrying side 11, so that the engaging sub-slots 141 defined on such plurality of first webbing strips could form a plurality of parallel extending passageway 142 longitudinally extended along the carrying side 11 of the carrier 10.

Here, the free tab end 342 has a predetermined stiffness adapted for facilitating such inserting maneuverability of the interfering strap 34. The predetermined stiffness is created by overlappedly folding the free tab end 342 back onto itself. It is noted that by tucking the stiffened free tab end 342 back to the transverse carrier slot 311 defined on the carrier 10, the interfering strap 34 is capable of coupling the carrier 10 and the holder 20 with a stable and secure manner.

Figure 2:
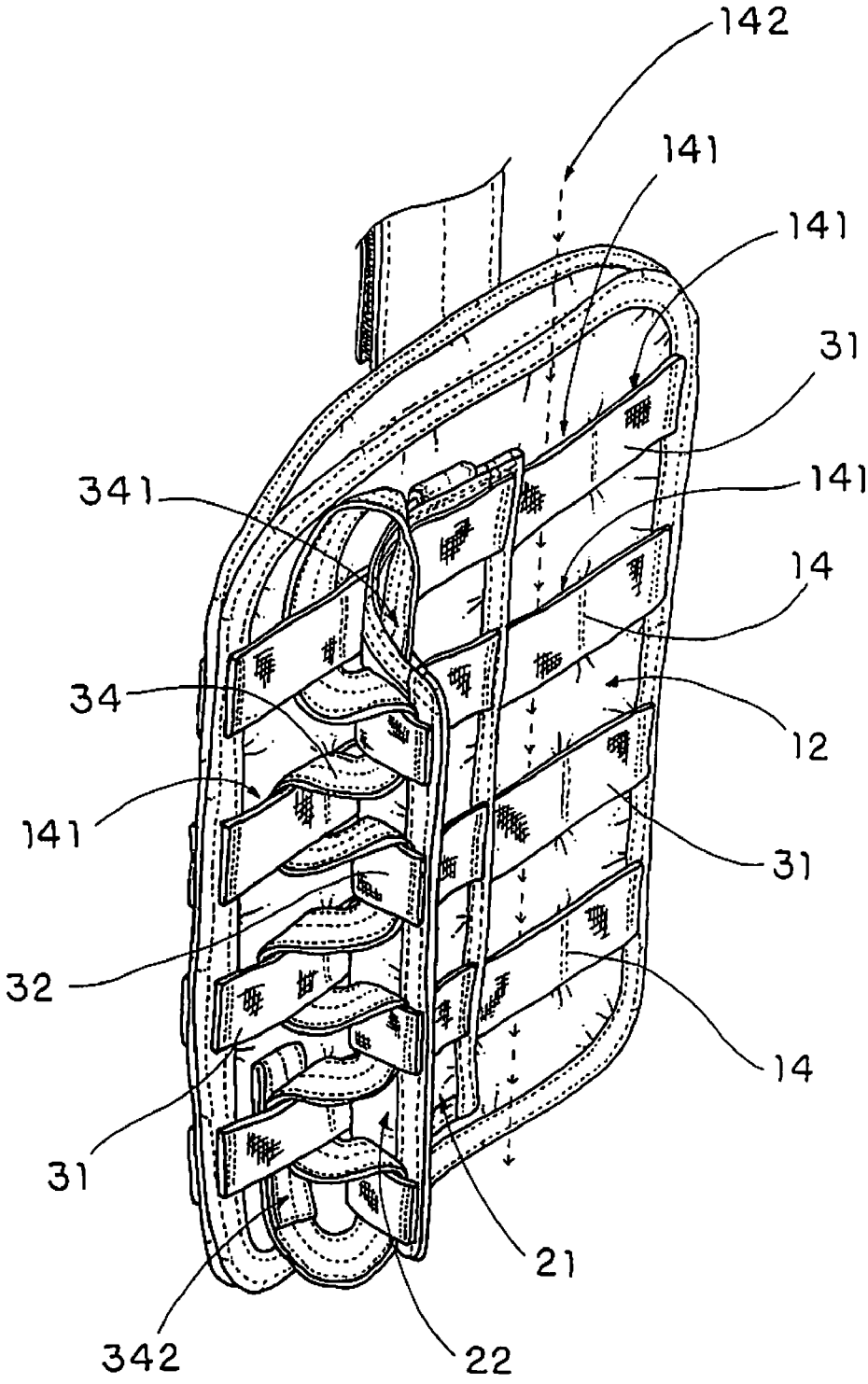
FIG. 2 is a perspective view of an embodiment of the present invention showing the stiffened free tab end of the interfering strap being tucked back into the strip webbing defined on the first object.
Figure 3:
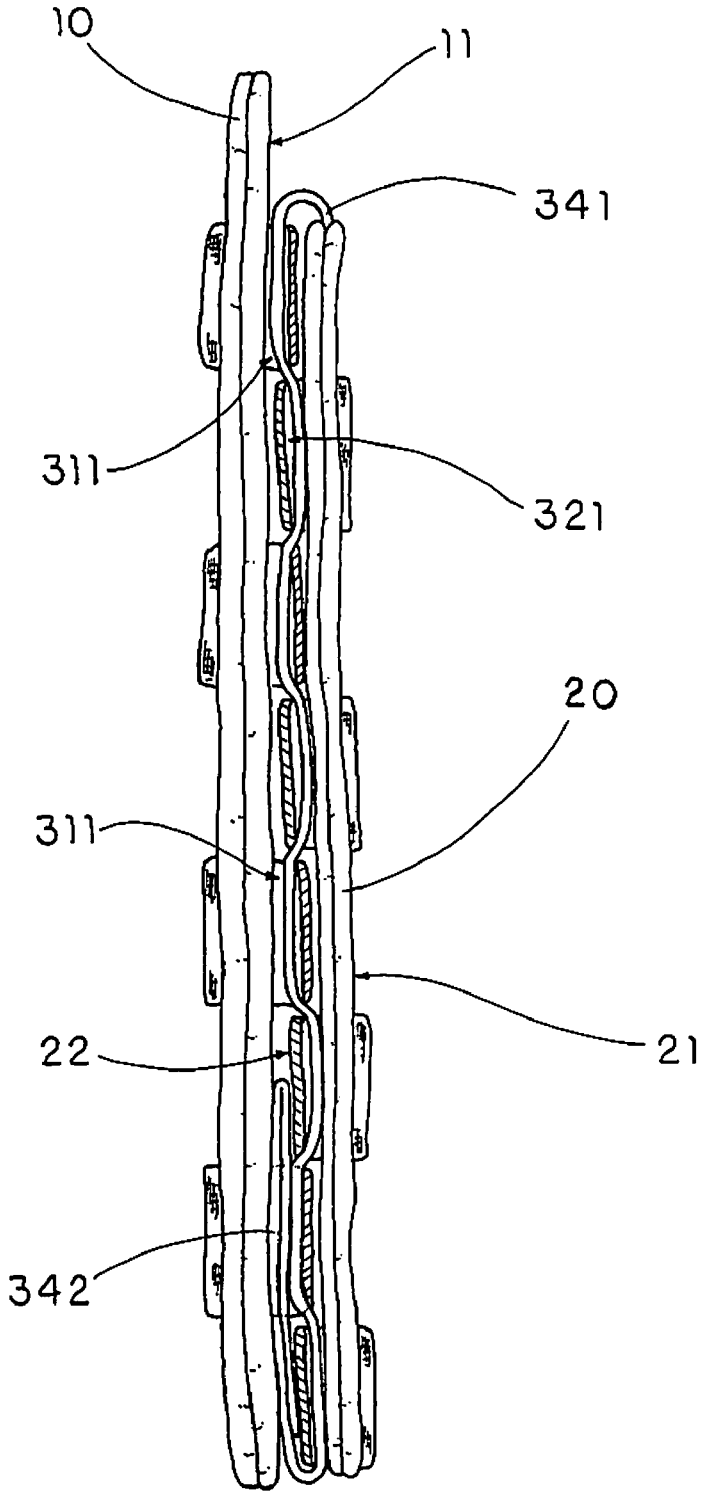
FIG. 3 is a side view of an embodiment of the present invention illustrating the interfering strap sequentially and slidably passing the first webbing strip and the second webbing strip and the free tab end is tucked back to the carrier with portions of the web strippings cut away for clarity.

This is due to the fact that the engaging sub-slots 141 and the extending passageways 142 are of substantial and corresponding size for permitting the insertion of the interfering strap 34. As shown in FIG. 2, the free tab end 342 is passed penetrating such extending passageway 142 for detachably attaching the holder 20 onto the carrier 10. The width of such extending passageway 142 will further restrict the interfering strap 34 from laterally shifting. In other words, the width of the interfering strap 34 is slightly smaller than a width of each of the engaging sub-slots 141 and extending passageway 142 such that the interfering strap 34 is slid through one of the holder slots 321 and then one of the carrier slots 311 in sequence.

As a result, the extending passageway 142 enables the free tab end 342 of the interfering strap 34 to alternatively pass the carrier slot 311 and the holder slots 321 in sequence to interweave the holder 20 and the carrier 10 together in a detachable manner.

Here, the interfering strap 34 is made of a predetermined length of flexible material, and preferably, the affixing end 341 is affixed to an upper edge of the holding side 21 of the holder 20, and the stiffened free tab end 342 is along the length of the interfering strap 34.

According to the present invention, the free tab end 342 of the interfering strap 34 is formed by folding a free end portion of the interfering strap 34 over a piece of rigid or semi-rigid material (such as a plastic tab) and fixing its location by sewing means. It is noted that other suitable means such as by gluing or fusing well known within the art could be used for forming such free tab end 342.

That is to say, the free end potion of the interfering strap 34 is overlapped to form the free tab end 342 to enhance the stiffness thereof so as to retain the free tab end 342 of the interfering strap 34 within the respective transverse carrier slot 311 when the free tab end 342 of the interfering strap 34 is overlappedly tucked back to the carrier 10.

Figure 4:
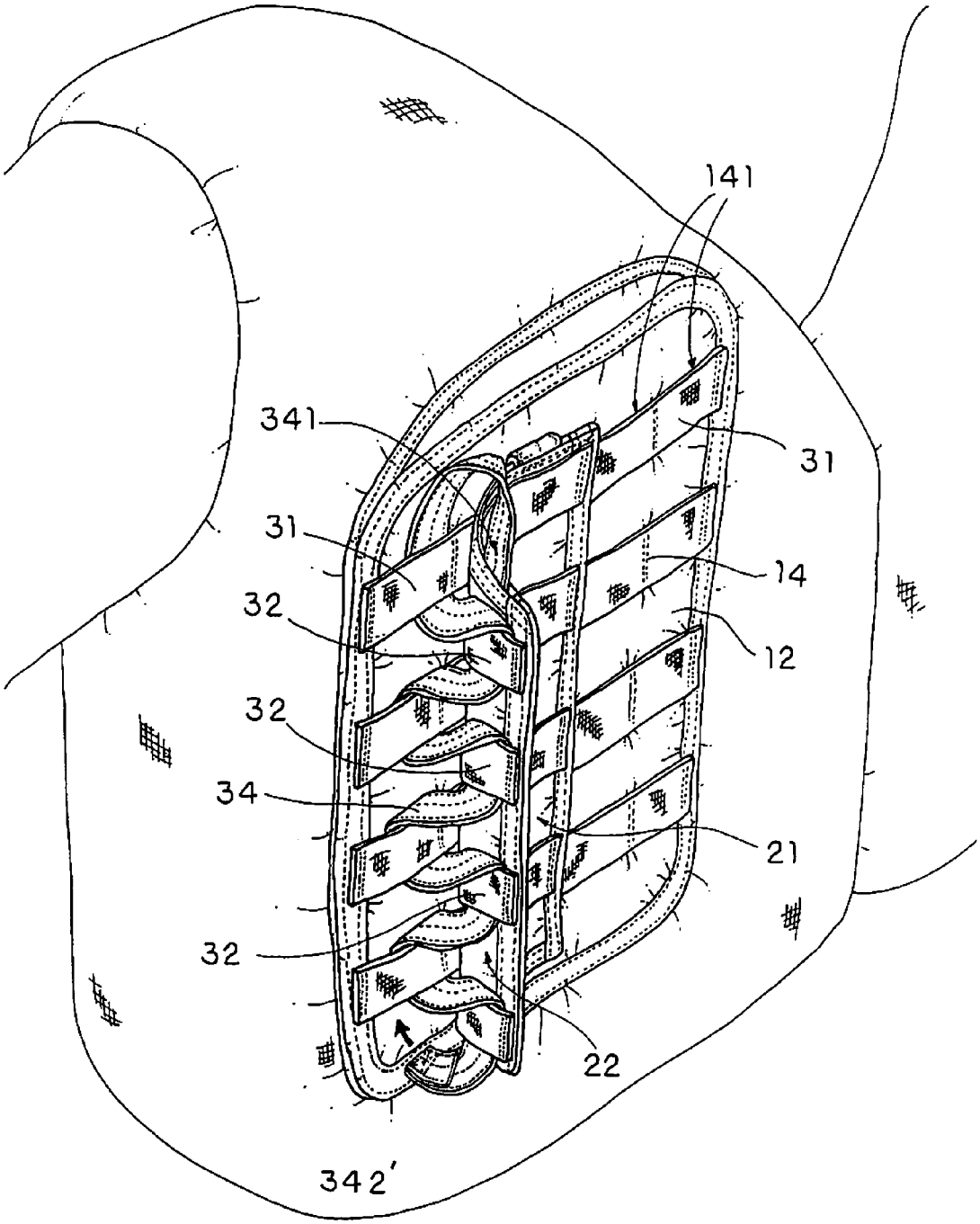
FIG. 4 is a perspective view of the carrier as a mounting panel of a utility vest.

As shown in FIG. 4, an alternative mode of such free tab end 342' is illustrated. The free tab end 342' of the interfering strap 34 has a hook structure 344 arranged to slide along the interlocking channel 33 towards the opposed peripheral edge of the holder 20 so as to prevent the interfering strap 34 from being pulled backward. Preferably, the hook structure 344 is tucked back and extended upwardly passing at least one first webbing strip 31, so that the hook structure is capable of blocking the interfering strap 34 from being pulled back.

Figure 5A:
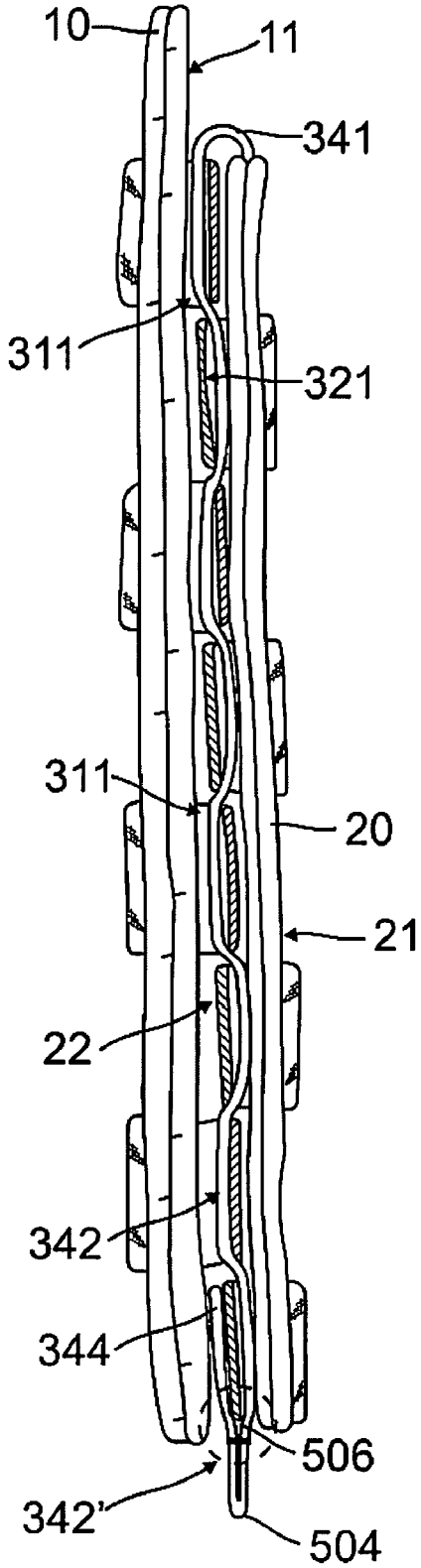
FIG. 5A is a side view of another embodiment of the present invention with portions of the web strippings cut away for clarity.
Figure 5B:
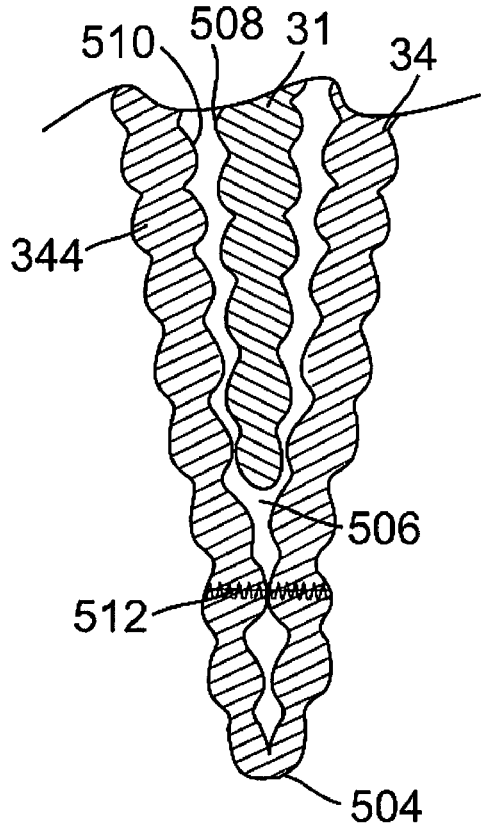
FIG. 5B is a blown up cross-sectional side view of a portion of the free tab end indicated at 342'.
Figure 6:
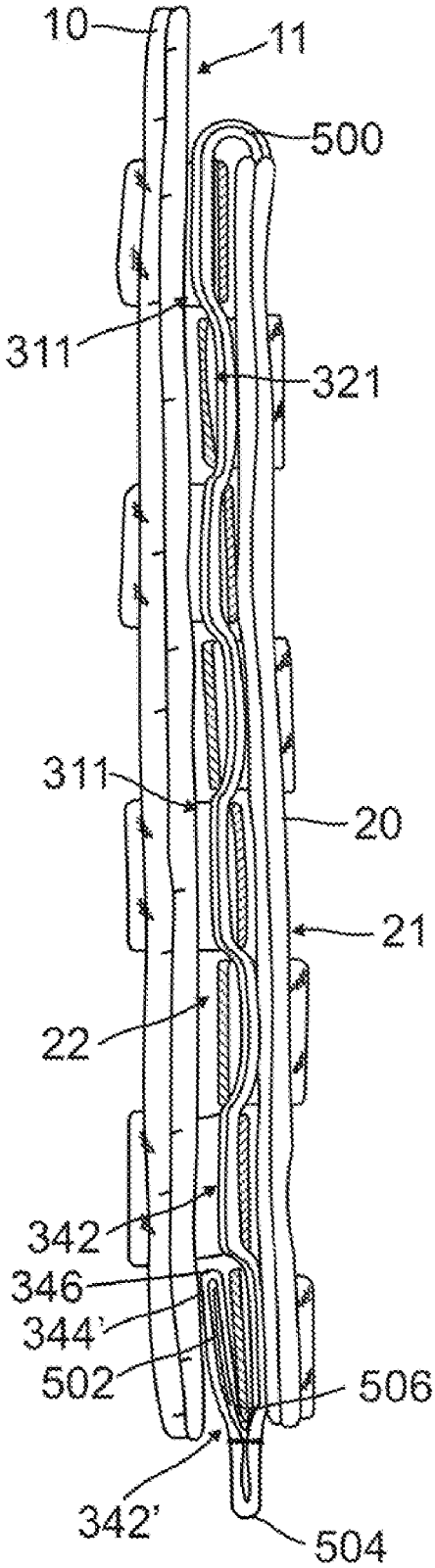
FIG. 6 is a side view of another embodiment of the present invention with portions of the web strippings cut away for clarity.

Alternatively, as shown in FIG. 5A through FIG. 6, the hook structure 344 defined on the free tab end 342' may be hooked on the bottom-most or last webbing strip, whether it be the second webbing strip 32 or the first webbing strip 31 so as to prevent the interfering strap 34 from being pulled backwards out of the interlocking channel 33. Obviously, the last webbing strip may be the top-most webbing strip, whether it be the first or second webbing strip 31, 32, if the interfering strap 34 was inserted from the bottom end of the carrier first.

To add stiffness and strength to the hook structure 344, the interfering strap 34 may be constructed as a dual layer strap 500 by folding the interfering strap 34 back onto itself at a first fold 346 and stitching the perimeter edges to form a dual layer hook structure 344' as shown in FIG. 6. A second fold 504 is created to fold the dual layer hook structure 344' back onto the interfering strap and secured by a securing means, such as stitching in between the first and second fold, to create a wedge 506. A stiffening member 502 may be inserted in between the double layers of the dual layer hook structure 344' at the free tab end 342' in between the first and the second folds 346, 504. In some embodiments, the stiffening member 502 may extend through out the free tab end 342'. The stiffening member 502 may be a rigid or semi-rigid piece of material, such as plastic, wood, metal, or the like. Alternatively, rather than using a dual layer strap 500 the free tab end 342' may be folded back on itself at a first fold 346 and stitched or otherwise secured to the interfering strap 34 to create the dual layer hook structure 344'.

The added stitchwork created by doubling the interfering strap 34 anchors and tightens the fabric of the strap 34, thereby strengthening the hook structure 502. By putting the second fold 504 in the strap and adding a stitch 512 between the dual layer strap 500 and the dual layer hook structure 344' (creating a bite), a V-shaped wedge 506 is created between the dual layer hook structure 344' and the remainder of the dual layer strap 500, which compresses on any cloth that is pulled into the V-shaped wedge 506. A similar V-shaped wedge 506 may be created in the single layer version of the interfering strap 341.

In some embodiments, to further enhance the grip, the first webbing strips 31 and/or the second webbing strips 32 may have a first ribbing 508. In addition, the interfering strap 34 may have a second ribbing 510. The ribbings 508, 510 are generally transverse in direction, meaning they follow the direction of the webbing strips. This allows the first and second ribbings 508, 510 to mate as shown in FIG. 5B as the ribbed webbing strip 508 engages the ribbed wedge 506 of the interfering strap 34.

The ribbing may be created by the special weaving of the fabric. For example, a MIL-W-43668 nylon fabric may be used to create the ribbing. In another embodiment, MIL-W-17337 can be used.

Metal on metal or plastic on plastic may not provide the slight sponginess of a fabric engaging fabric. Additionally, although a U-shaped wedge can also be used, it is believed that a V shape wedge provides better compression than a U-shaped wedge.

To further enhance the grip, a resin may be applied to, embedded in, or impregnated into the webbing strips 31, 32 and/or the interfering strap 34. The resin can provided enhanced stiffness to the interfering strap 34 and/or the first and second webbing strips 31, 32.

In some embodiments, the wedge 506 and the bottom portion of the webbing strips 31 or 32 may comprise a hook-and-loop fastening system to facilitate securing the hook structure 344 or 344' on the webbing strips 31 or 32. Alternatively, the hook and loop fastening system may be presented on the surface of last webbing strip, whether it be the top most, bottom most, the first or the second webbing strip, and the portion of the hook structure that makes contact with the surface of the last webbing strip.

In some embodiments, at least a portion of the interfering strap 34 may be elastic so that when the hook structure is hooked onto the last webbing strip, the elasticity of the interfering strap pulls the free tab end towards the upper edge of the holder so as to wedge the hook structure into the last webbing strip by applying a biasing force to pull the hook in a backward direction.

This is particularly important for military personnel trying to minimize the amount of equipment they carry. By reducing hardware and creating the strap system by stitching, military personnel, in particular, are able to repair any damage to the strap system simply by stitching the fabric back together.

Additionally, the carrier 10 further comprises two length-adjustable thigh belts 13 sidewardly extended from two side edges of the carrier 10 respectively for detachably fastening the carrier 10 on the wearer's thigh. Or otherwise, as shown in FIG. 4, the carrier 10 is embodied as a mounting panel of a utility vest.

Conclusively, after sequentially inserting the interfering strap 34 through the first webbing strip 31 and the second webbing strip 32, the stiffened free tab end 342 could be tucked back into the carrier slot 311 as well as the extending passageways 142 for securing the free tab end 342 of the interfering strap 34 in position.

That is to say, the interfering engaging strap 34 has an affixing end 341 provided on the holder 20, which has a loading side 21 for carrying objects, and a free tab end 342 which is capable of being detachably tucked back into the carrier 10, such as a vest, or a mounting pad. In comparison with prior art, no hardware is associated to fasten the free tab end 342, more importantly, two ends of the interfering strap 34 are respectively defined on the carrier and holder instead of the same object.

Unquestionably, the free tab end design of the present invention poses a huge advantage over the prior art. In case of the holder 20 is bulky or heavily stuffed, the interfering strap 34 with two ends disposed on the holder 20 would be susceptible to unwanted disengagement. However, according to the present invention, the free tab end 342 is fittingly and tightly received back into the engaging passageways 142 defined on the carrier 10, so that a bulgy holder 20, such as a heavily stuffed pouch, will increase the engaging pressure on the free tab end 342 of the interfering strap 34 thus biasing the interfering strap 34 flatly and tightly sandwiched between the carrier 10 and holder 20.

It is noted that the quantity of such interfering strap 34 is dependent on the size of the holder 20. In case of a heavy-loaded holder is in application, a proportionally increased number of such interfering strap 34 would be used for achieve a securer engagement.

Furthermore, the present invention introduces a method for interlocking a carrier with a holder, comprising the steps of: (a) slidably passing a tab end of an interfering strap through one of first webbing strips transversely extended on the carrier, wherein the interfering strap is longitudinally extended on the holder and has an affixing end extended from a peripheral edge of the holder; (b) slidably passing the tab end of the interfering strap through one of second webbing strips transversely extended on the holder; (c) slidably passing the tab end of the interfering strap through the succeeding first webbing strip on the carrier; (d) slidably passing the tab end of the interfering strap through the succeeding second webbing strips on the holder to interlock the first webbing strips with the second webbing strips so as to securely mounting the holder on the carrier; and (e) overlappedly tucking the tab end of the interfering strap back to the first webbing strip on the carrier to enclose the tab end of the interfering strap between the carrier and the holder so as to securely reinforce the holder on the carrier via the interfering strap.

In some embodiments, the present invention provides for a method interlocking a carrier with a holder, comprising said steps of (a) slidably passing a free tab end of an interfering strap through one of first webbing strips transversely extended on said carrier, wherein said interfering strap is longitudinally extended on said holder and has an affixing end extended from a peripheral edge of said holder; (b) slidably passing said free tab end of said interfering strap through one of second webbing strips transversely extended on said holder; (c) slidably passing said free tab end of said interfering strap through said succeeding first webbing strip on said carrier; (d) slidably passing said free tab end of said interfering strap through said succeeding second webbing strips on said holder to interlock said first webbing strips with said second webbing strips so as to securely mount said holder on said carrier, wherein said free tab end of said interfering strap comprises a dual layer hook structure comprising a stiffening member to enhance a stiffness of said hook structure; and (e) wedging a last webbing strip in between said dual layer hook structure and said interfering strap to prevent said interfering strap from being pulled backward.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An interlock attaching strap system, comprising:

a. a carrier, having a carrying side, adapted for being carried by a wearer;

b. a holder having a loading side and an opposed holding side corresponding to said carrying side of said carrier; and c. an interlocking arrangement, which comprises:

i. a plurality of first webbing strips transversely, evenly and spacedly affixed on said carrying side of said carrier and defining a plurality of transverse carrier slots between said first webbing strips and said carrying side of said carrier;

ii. a plurality of second webbing strips transversely, evenly and spacedly affixed on said holding side of said holder and defining a plurality of transverse holder slots between said holding side of said holder to align with said transverse carrier slots respectively to form an elongated interlocking channel when said holding side of said holder is overlapped on said carrying side of said carrier to alternate said first webbing strips with said second webbing strips;

iii. at least an elongated interfering strap, which is longitudinally extended on said holder, having an affixing end extended from a peripheral edge of said holder and a free tab end, which is arranged to slidably pass through said interlocking channel to securely interlock said holder with said carrier so as to securely reinforce said holder on said carrier via said interfering strap, iv. wherein said free tab end of said interfering strap comprises a first fold to create a dual layer hook structure, a second fold to fold the dual layer hook structure back on to the interfering strap, and a securing means to secure the dual layer hook structure to the interfering strap to create a wedge between the dual layer hook structure and the interfering strap, wherein the securing means is between the first fold and the second fold.

2. The interlock attaching strap system of claim 1, wherein said dual layer hook structure comprises a stiffening member to enhance said stiffness of said dual layer hook structure.

3. The interlock attaching strap system of claim 2, wherein said stiffening member extends throughout said free tab end.

4. The interlock attaching strap system of claim 2, wherein a resin is applied to said interfering strap to enhance said stiffness of said free tab end.

5. The interlock attaching strap system of claim 4, wherein said plurality of first webbing strips, said plurality of second webbing strips, and said interfering strap are each transversely ribbed.

6. The interlock attaching strap system, as recited in claim 2, wherein a portion of said interfering strap is elastic.

7. The interlock attaching strap system, as recited in claim 2, wherein said last webbing strip and said hook structure comprise a hook and loop fastening system to secure the hook structure to the last webbing strip.

8. The interlock attaching strap system, as recited in claim 2. wherein said carrier is a vest garment adapted for said wearer to wear said carrier.

9. The interlock attaching strap system of claim 1, wherein a resin is applied to said interfering strap to enhance said stiffness of said free tab end.

10. An interlock attaching strap system, comprising:

a. carrier, having a carrying side, adapted for being carried by a wearer;

b. holder having a loading side and an opposed holding side corresponding to said carrying side of said carrier; and c. an interlocking arrangement, which comprises:

i. plurality of first ribbed webbing strips transversely, evenly and spacedly affixed on said carrying side of said carrier and defining a plurality of transverse carrier slots between said first webbing strips and said carrying side of said carrier;

ii. a plurality of second ribbed webbing strips transversely, evenly and spacedly affixed on said holding side of said holder and defining a plurality of transverse holder slots between said holding side of said holder to align with said transverse carrier slots respectively to form an elongated interlocking channel when said holding side of said holder is overlapped on said carrying side of said carrier to alternate said first webbing strips with said second webbing strips;

iii. at least a ribbed interfering strap, which is longitudinally extended on said holder, having an affixing end extended from a peripheral edge of said holder and a ribbed free tab end, which is arranged to slidably pass through said interlocking channel to securely interlock said holder with said carrier so as to securely reinforce said holder on said carrier via said ribbed interfering strap, iv. wherein said ribbed free tab end of said ribbed interfering strap comprises a first fold to create a dual layer hook structure, a second fold to fold the dual layer hook structure back on to the interfering strap, and a securing means to secure the dual layer hook structure to the interfering strap to create a wedge between the dual layer hook structure and the interfering strap, wherein the securing means is between the first fold and the second fold.

11. The interlock attaching strap system of claim 10, wherein a resin is applied to said ribbed interfering strap to enhance said stiffness.

12. The interlock attaching strap system of claim 11, wherein said double layer at said free tab end comprises a stiffening member to enhance said stiffness of said free tab end.

13. The interlock attaching strap system of claim 10, wherein a portion of said interfering strap is elastic.

14. The interlock attaching strap system of claim 10, wherein said last webbing strip and said hook structure comprise a hook and loop fastening system to secure the hook structure to the last webbing strip.

15. The interlock attaching strap system of claim 10, wherein said carrier is a vest garment adapted for said wearer to wear said carrier.

16. A method of interlocking a carrier with a holder, comprising the steps of:

a. slidably passing a free tab end of an interfering strap through one of first webbing strips transversely extended on said carrier, wherein said interfering strap is longitudinally extended on said holder and has an affixing end extended from a peripheral edge of said holder;

b. slidably passing said free tab end of said interfering strap through one of second webbing strips transversely extended on said holder;

c. slidably passing said free tab end of said interfering strap through a succeeding first webbing strip on said carrier;

d. slidably passing said free tab end of said interfering strap through a succeeding second webbing strip on said holder to interlock said first webbing strips with said second webbing strips so as to securely mount said holder on said carrier, wherein said free tab end of said interfering strap comprises a first fold to create a dual layer hook structure, a second fold to fold the dual layer hook structure back on to the interfering strap, and a securing means to secure the dual layer hook structure to the interfering strap to create a wedge between the dual layer hook structure and the interfering strap, wherein the securing means is between the first fold and the second fold; and e. wedging a last webbing strip in between said dual layer hook structure and said interfering strap to prevent said interfering strap from being pulled backward.

17. The method of claim 16, wherein said last webbing strip and said interfering strap are each transversely ribbed so as to mate with each other when wedged.

18. The method of claim 17, wherein a resin is applied to said interfering strap to enhance said stiffness of said hook structure.

* * * * *